US008120543B2

(12) United States Patent
Sulima et al.

(10) Patent No.: US 8,120,543 B2
(45) Date of Patent: Feb. 21, 2012

(54) TRANSMISSION LINE SLOT ANTENNA

(76) Inventors: Oleksandr Sulima, Toronto (CA); Volodimir Veremey, Santa Clara, CA (US)

( * ) Notice: Subject to any disclaimer, the term of this patent is extended or adjusted under 35 U.S.C. 154(b) by 374 days.

(21) Appl. No.: 12/581,345

(22) Filed: Oct. 19, 2009

(65) Prior Publication Data

US 2011/0090128 A1 Apr. 21, 2011

(51) Int. Cl.
*H01Q 13/10* (2006.01)

(52) U.S. Cl. ..... 343/767; 343/702; 343/841; 343/829; 343/846

(58) Field of Classification Search ..... None
See application file for complete search history.

(56) References Cited

U.S. PATENT DOCUMENTS

| | | | | |
|---|---|---|---|---|
| 2,508,085 | A | 5/1950 | Alford | |
| 2,799,017 | A | 7/1957 | Alford | |
| 5,724,048 | A * | 3/1998 | Remondiere | 343/700 MS |
| 5,825,333 | A * | 10/1998 | Kudoh et al. | 343/781 R |
| 6,218,997 | B1 * | 4/2001 | Lindenmeier et al. | 343/725 |
| 6,307,520 | B1 | 10/2001 | Liu | |
| 6,384,793 | B2 * | 5/2002 | Scordilis | 343/767 |

OTHER PUBLICATIONS

Nosich et al., "Principal and Higher Order Modes of Microstrip and Slot Lines on a Cylindrical Substrate," *Electromagnetics*, vol. 13, 1993, pp. 85-94.

Sulima, Cavity—Backed Slot Antenna, *IEEE, Int. Antennas Propagation. Symposium Digest*, vol. 41, Jun. 2003, pp. 494-496.

Veremey, "Scattering from Structures Formed by Resonant Elements," *IEEE Transactions on Antennas and Propagation*, vol. 46, No. 4, Apr. 1998, pp. 494-501.

Veremey, et al., "Two-Dimensional Scattering from CBA with Resonant Loading," *IEEE Antennas Propagat. Soc. Symp.*, Seattle, Washington, Jun. 1994, vol. 2, pp. 1090-1093.

Sulima, "Scattering of TE Waves by Cavity Backed Slots," *Proceedings of the 32nd European Microwave Conference*, 2002, Milan, Italy,. 4 pages.

Veremey et al., "Scatterers with Resonant Cavities," *Antennas and Propagation Society International Symposium*, Jun. 1995, pp. 422-425.

Veremey, "Superdirective Antennas with Passive Reflectors," *IEEE Antennas and Propagation Magazine*, vol. 37, 1995, pp. 16-27.

* cited by examiner

*Primary Examiner* — Trinh Dinh

(74) *Attorney, Agent, or Firm* — Davis Wright Tremaine LLP

(57) ABSTRACT

A transmission line slot antenna is described. Although more generally applicable, the antenna is particularly adapted to conformal applications. The antenna has a ground plate with a conductive top surface having a slot with a feed whose ground reference terminal is connected to one side of the slot and whose signal terminal is connected to the other side of the slot. A conductive cylindrical screen, which can be of an arbitrary cross section and non-uniform in the longitudinal direction, is formed of one or more sections attached along the bottom surface of the ground plate, with each of the sections having a first and second edge conductively connected to the top surface of the ground plate along opposite sides of the slot. The antenna is tuned to support the fundamental mode ($H_{00}$) of a slotted cylinder transmission line formed by the screen sections and a part of the ground plate with the slot.

14 Claims, 16 Drawing Sheets

*FIG.6b Return loss versus frequency*

TRANSMISSION LINE SLOT ANTENNA

FIELD OF THE INVENTION

This invention pertains generally to the field of antennas and more specifically to slot antennas formed by a slotted cylinder transmission line that can be of non-uniform cross-section.

BACKGROUND

Slot antennas have been widely investigated over the past 60 years. Slot antennas can be divided into two groups: slot antennas in a screen and boxed-in slot antennas. Slot antennas in a screen are wideband antennas that radiate in two directions. Boxed-in slot antennas are narrow band antennas that radiate in only one direction. The narrow bandwidth of operation of boxed-in antennas is achieved by cutting a radiating slot in a wall of a resonant cavity tuned to resonate on the $TE_{10}$ mode. The resonant cavity substantially increases the size of the antenna, even in a space saving configuration presented in U.S. Pat. No. 6,307,520, and makes the antenna narrowband. The prior art of slot antennas failed to combine in one design wide bandwidth of operation with the directional property of boxed-in slot antennas.

SUMMARY OF THE INVENTION

The conductive top surface of the antenna's ground plate has a slot of length L and width W with the width W less than the length L. A feed has its ground reference terminal connected to one side of the slot and a signal terminal connected to the other side of the slot. A conductive cylindrical screen of one or more sections running lengthwise along the slot is attached along the bottom surface of the ground plate. Each of the conductive cylindrical screen sections has the first and the second edge conductively connected to the top surface of the ground plate along opposing respective sides of the slot and is tuned to support the fundamental mode ($H_{00}$) of a slotted cylinder transmission line formed by the screen sections and the ground plate with the slot. The cylindrical screens in this configuration can have an arbitrary cross-section. The cylindrical screens can be non-uniform in the longitudinal direction.

Various aspects, advantages, features and embodiments of the present invention are included in the following description of exemplary examples thereof, which description should be taken in conjunction with the accompanying drawings. All patents, patent applications, articles, other publications, documents and things referenced herein are hereby incorporated herein by this reference in their entirety for all purposes. To the extent of any inconsistency or conflict in the definition or use of terms between any of the incorporated publications, documents or things and the present application, those of the present application shall prevail.

BRIEF DESCRIPTION OF THE DRAWINGS

The various aspects and features of the present invention may be better understood by examining the following figures, in which:

FIGS. 6*b*-6*d* give the response of the embodiment of FIG. 6*a*.

DETAILED DESCRIPTION

Figure 1A:
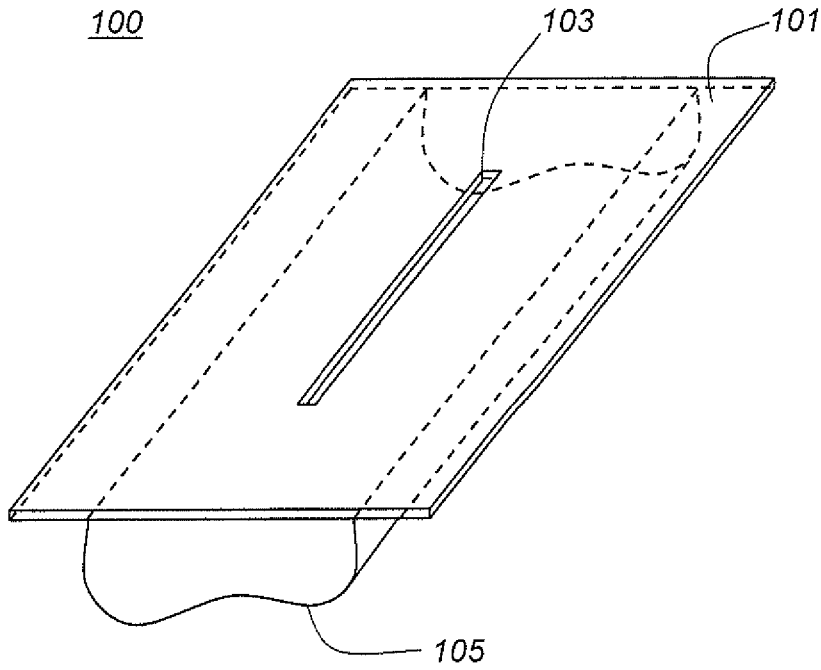
FIGS. 1*a*-1*e* show various configurations of the ground plate with the slot and screens forming slotted cylinder transmission line.
Figure 1B:
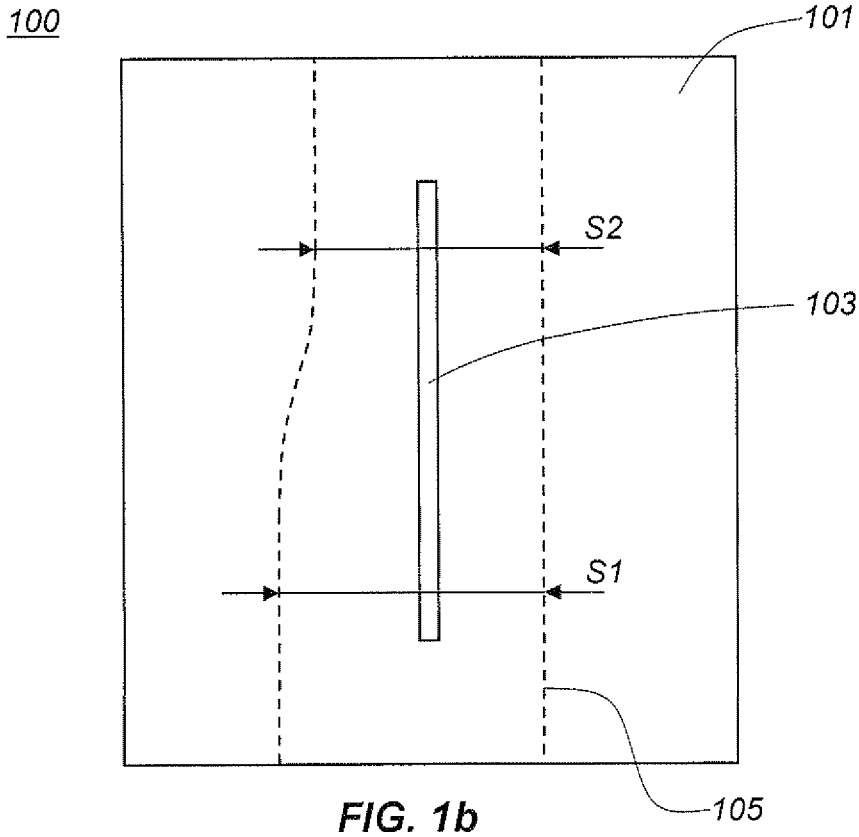
Figure 1C:
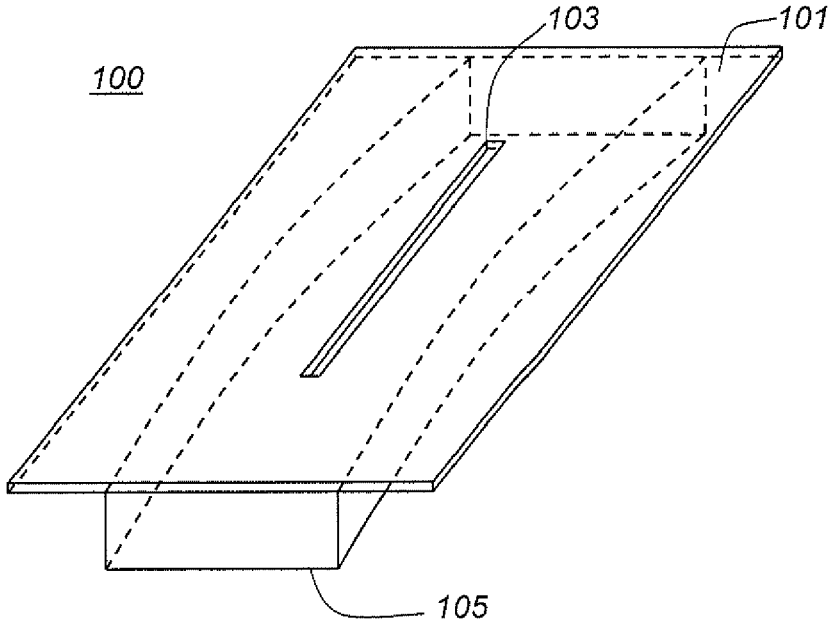
Figure 1D:
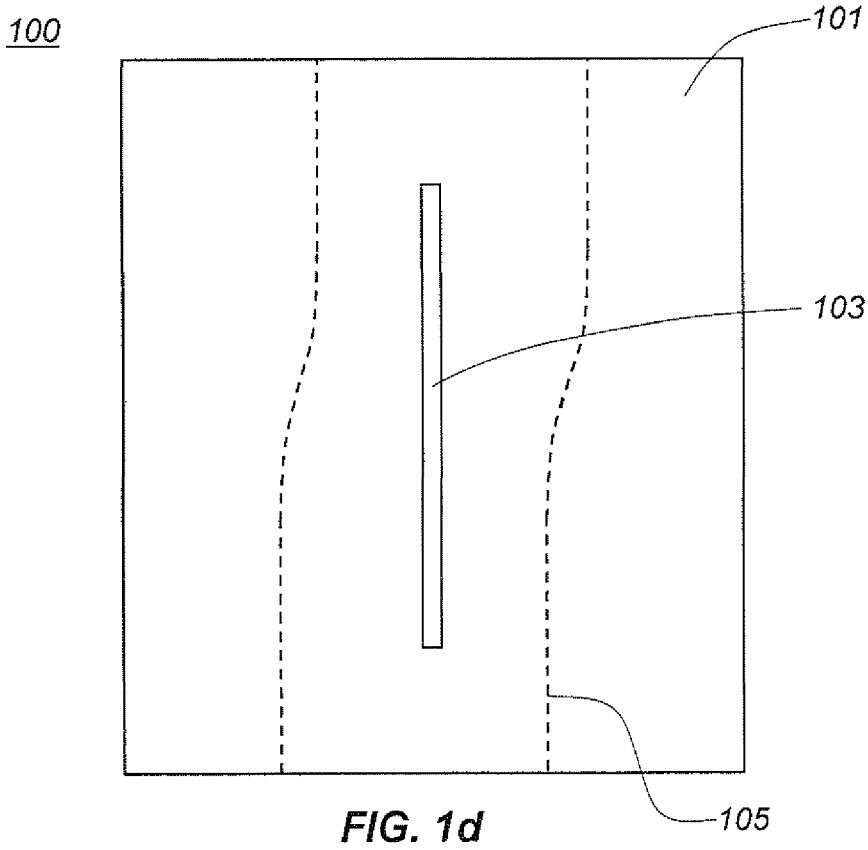
Figure 1E:
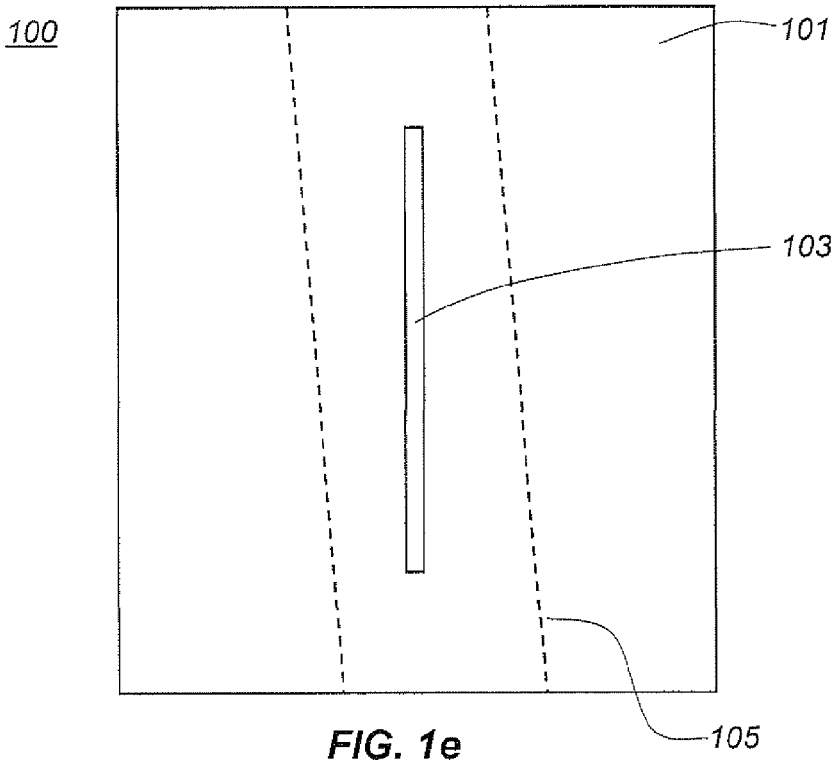

The slot antenna presented here is, according to various aspects, formed by a section of non-uniform slotted cylinder transmission line with either open or closed ends, variable cross section configuration, and variable direction of the transmission line. Further, the transmission line can be conformal to the space available for the antenna. The antenna also can include a ground plate to form a radiation pattern of the antenna predominantly in a hemisphere. The body of the transmission line can be non-uniform and can also include windows through which a coaxial cable or an micro-strip line reaches the excitation point at the mid-point of the slot or its vicinity, for a single frequency operation mode, or at a point off the midpoint, for a dual frequency operation mode. Open ends of the transmission line can also be used by a feeding network to access the excitation point of the antenna. The body of the transmission line can also have a number of windows or non radiating slots for technological purposes. The length of the radiating slot of the antenna can be made longer than the transmission line length.

As noted in the Background, the prior art of slot antennas failed to combine in one design wide bandwidth of operation with the directional property of a boxed-in slot antenna. The antenna presented here addresses the need for a wideband slot antenna radiating in one direction. The proposed antenna design can be used in sector antennas, directional panel antennas or antenna arrays. The presented antenna includes a section of a slotted cylinder transmission line (or, alternately, open cylindrical waveguide, open cylindrical waveguide with longitudinal slot, or slotted cylindrical waveguide) with the slot shorted at both ends and a ground plate overlapping with a part of the transmission line. The slot width W, the transmission line shape, and the cross-section area are all chosen to provide conditions for the antenna to operate at a wavelength $\lambda$ in the band $\lambda_{TE}<\lambda<\lambda c$, where $\lambda c$ is the cut-off wavelength of the basic mode of operation of a slotted cylinder transmission line ($H_{00}$) and the $\lambda_{TE}$ is the cut-off wavelength of the first propagating mode in the cylinder without slot. The $\lambda c$ of a slotted cylinder transmission line is a function of the slot width W, the shape and the area of the transmission line cross-section.

Considering the existence and frequency of an $H_{00}$ mode, the distance around the screen (or screens) and the cross section area are the two important factors that ultimately define conditions for the $H_{00}$ mode's existence. The shape of the cross section, however, can also be important. For example, take the ease of a cylinder with a square cross-section. When the cylinder is compressed without changing the perimeter length, the $H_{00}$ mode will vanish at some point. In general, the resonance frequency of the $H_{00}$ mode in a cylinder with a longitudinal slot can be calculated only numerically. In very specific cases, e.g. when the cross-section of the cylinder is a circle, some simple analytical formulas can be derived. The conformal application case considered here encompasses a broad family of configurations. Thus, the full analysis of the presented antenna design can only be done numerically. The physics of the effect studied here can be effectively illustrated on a simplified case where the cross-section of the cylinder is a circle and the slot is narrow. In H-mode, the currents flowing in the azimuthal direction prevail. Thus, the surface of the cylinder is an inductive loop and the edges of the slot form a capacitor. Consequently, the resonance frequency depends on two factors: the capacitance of the capacitors formed by the edges of the slot, and the inductance of current on the surface of the cylinder.

FIGS. 1*a*-1*e* show several variations on the basic configuration of the slot antenna to illustrate different arrangements of the open cylinder conductive screen that form the transmission line. FIG. 1*a* shows the antenna 100 with the ground plate 101, the conductive top surface, and the slot 103. The cross-section of the slotted cylinder transmission line 105 is formed by a conductive screen that is conductively connected to the top surface of the ground plate. The shape of the cross-section of the slotted cylinder transmission line 105 can be arbitrary. The body of the transmission line 105 can be of various configurations. In particular cases presented in the FIGS. 1*b* and 1*c*, the slotted cylinder transmission has a rectangular cross-section as well as more general shapes. The area of any cross section of the line may be a variable function along the line length, as in FIG. 1*b*. The body of the transmission line can be bent as in the FIG. 1*c* or "shifted" as in the FIG. 1*d*. In most configurations, the transmission line 105 has an axis running lengthwise along the length of the slot, so that the axis of transmission line sections are substantially (that is, more or less) parallel to the length of the slot. However, the slot edges need not be parallel to the transmission line body, as in FIG. 1*e*. In general, the slot can be tilted, askewed to relative direction of the cylindrical screen section axes, or even zigzagged. The slot should not be arranged in a perpendicular direction relatively to the cylinder axes. Additionally, depending on the space available for the antenna, the slot in the antenna can be of a straight or of a bent type as in FIGS. 1*a* and 1*c*. This versatility for the arrangement of the screen (or screens) forming the body of the transmission line 105, allowing the transmission line to conform to the available space, is one of the practical advantages of the design.

Although shown open in the figures, the ends of the screen (or screens) forming the slotted cylinder transmission line 105 can also be closed. Such an antenna will typically be in a plastic enclosure to prevent dust and moisture accumulation. In other cases, the end-walls can keep the inside clean and free of insects. For example, for a single section screen longer than the slot, these end-walls can be conductive or non-conductive and may also include an opening for the antenna feed if needed. For the case of multiple screen sections, the gaps between adjacent section could be filled, for example, with a thin dielectric layer or film, or the line itself could even be a flexible film with conductive sections. Also, the slot itself may be covered or filled by a dielectric layer (as 113 in FIG. 3*f* discussed below).

The transmission line in the presented antenna has an arbitrary cross section and may or may not include conductive ends. The components of the antenna presented here are arranged to support the fundamental radiation waveguide mode, $H_{00}$, of the open cylindrical waveguide formed by the screen, the ground plate, and the slot. In prior art, a rectangular waveguide is used, and it is assumed that the rectangular waveguide supports the $TE_{10}$ mode that propagates in the direction orthogonal to the slot. In some prior art, the electromagnetic waves propagate in the direction normal to the ground plane and the slot. In U.S. Pat. No. 6,307,520, the box is positioned in such way that the $TE_{10}$ mode waves propagate in the direction that is still orthogonal to the slot, but parallel to the ground plate. The antenna presented here uses the "open cylindrical waveguide" (also know in the literature as "open cylindrical waveguide with longitudinal slot" and "slotted cylindrical waveguide"), and the fundamental mode of this waveguide referred to as $H_{00}$. In this mode, the slot defines the direction of the $H_{00}$ mode, with waves in the waveguide propagating in the direction along the waveguide axis, i.e. in the direction of the slot.

Similarly, in the prior art, the length of the slot 103 has been shorter than or equal to the length of the cavity formed by the transmission line. In the antenna presented here, the length of the slot, L, can be shorter, equal or longer than the transmission line length, $L_{tr}$, as shown respectively in the FIGS. 2*a*, 2*b* and 2*c*.

Figure 2A:
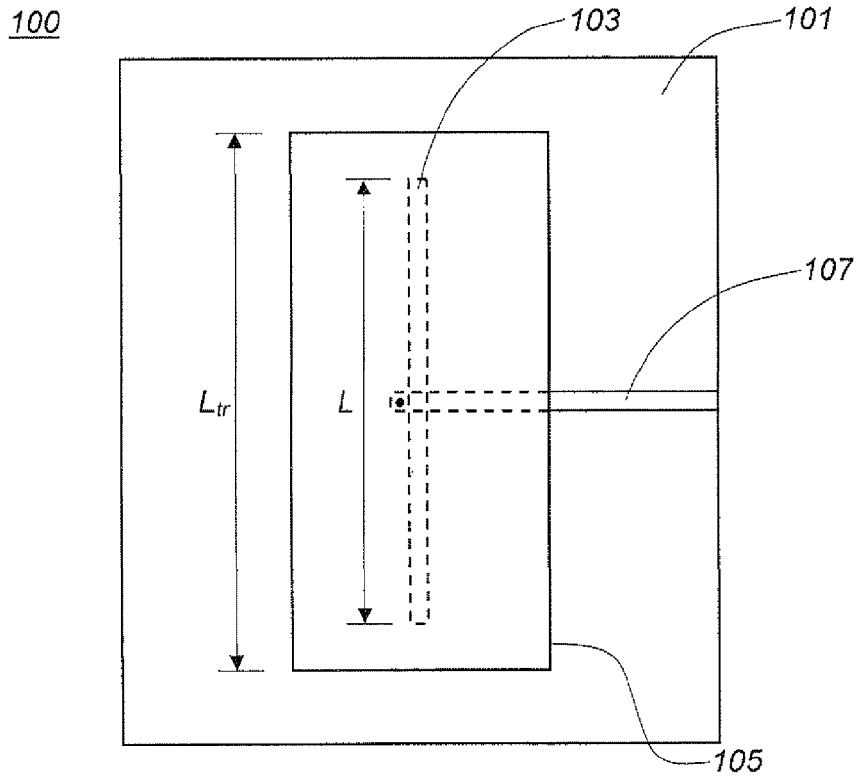
FIGS. 2*a*-2*c* illustrate embodiments with differing lengths of transmission line.
Figure 2B:
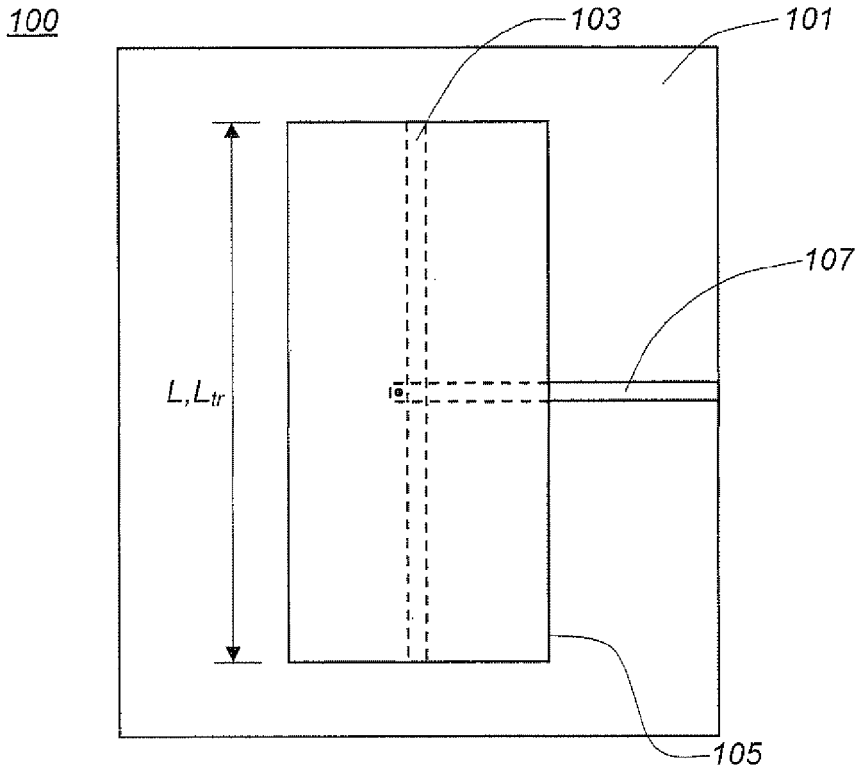
Figure 2C:
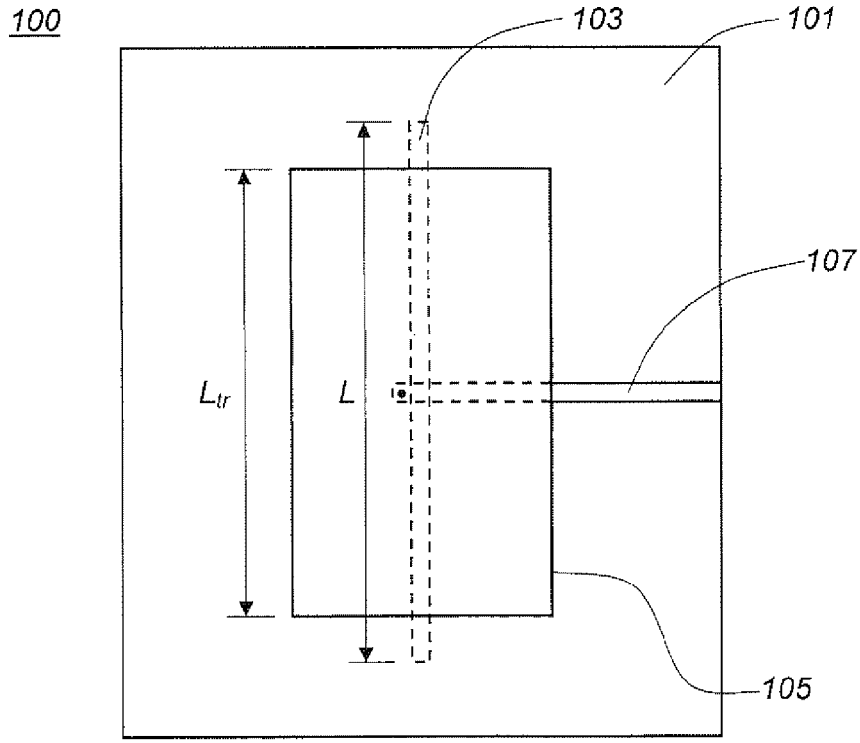

In FIGS. 2*a*-2*c*, the feeding network 107 of the antenna is shown. The feed has its ground reference terminal connected to the conductive top surface of the ground plate 101 on one of the sides of the slot 103 and the signal terminal connected to the other of the sides of the slot 103. In these figures, the excitation point of the antenna is shown as located either in the mid-point of the slot or in its neighborhood. As discussed below, in some cases the excitation point may be positioned off center. The antenna can be excited either by a coaxial or a micro-strip (or "m-strip") transmission line.

Figure 3A:
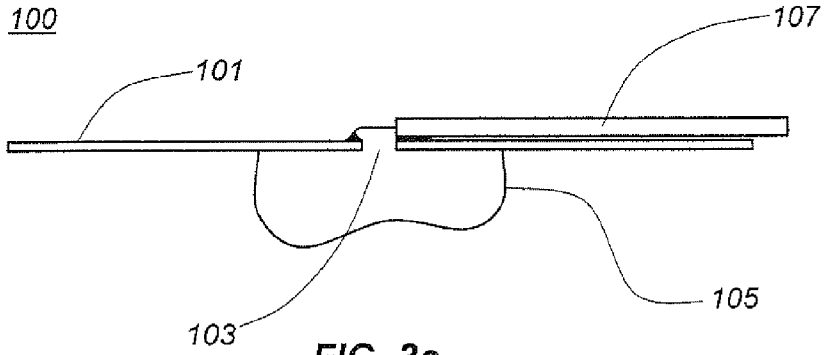
FIGS. 3*a*-3*i* show various details of how the feed line can be connected.
Figure 3B:
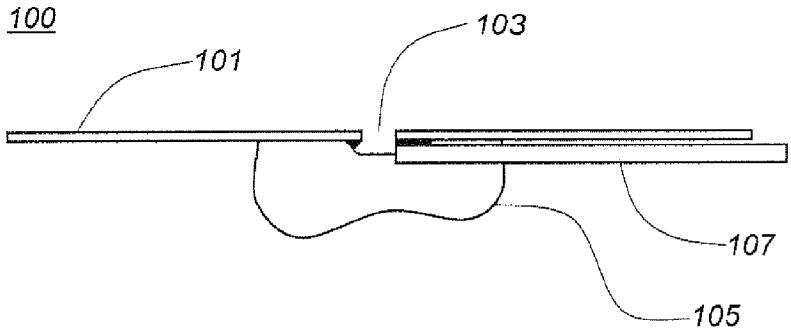
Figure 3C:
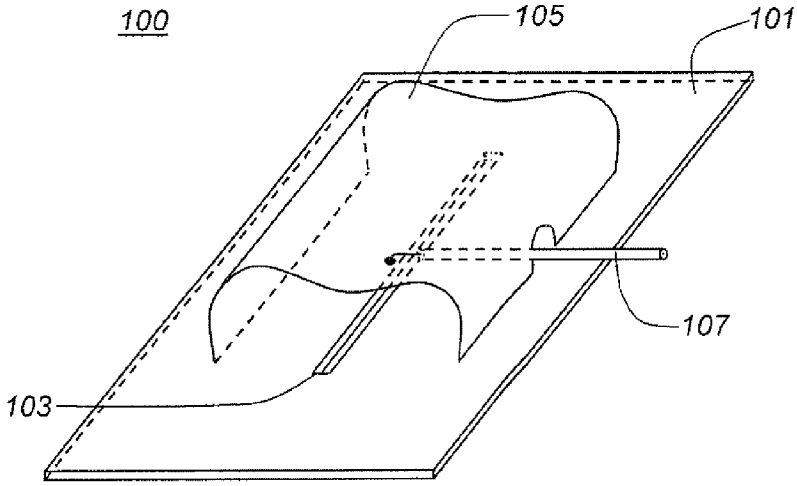
Figure 3D:
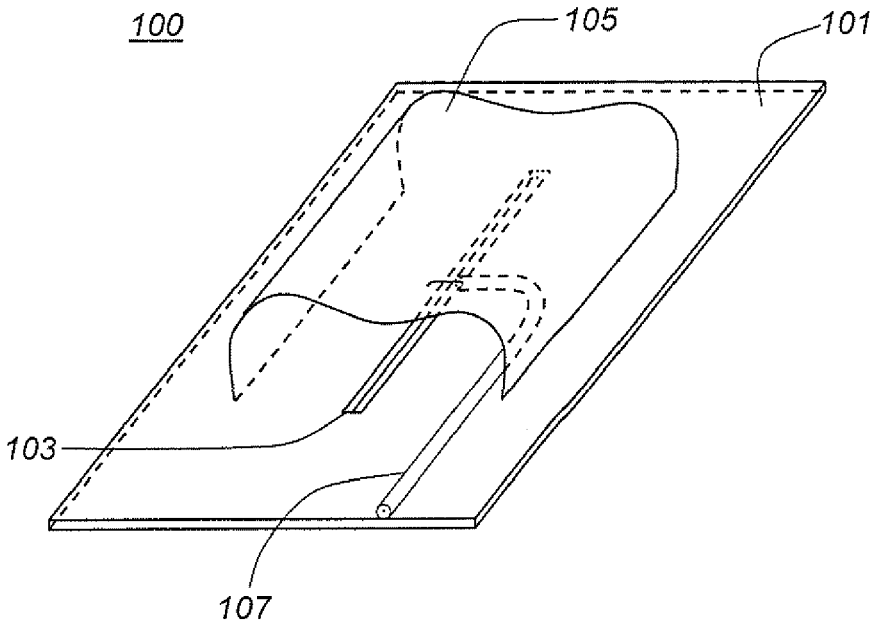

FIGS. 3*a*-3*d* show some of the possibilities for excitation by a coaxial line 107. In FIGS. 3*a* and 3*b*, the coaxial line 107 is placed on the top and on the bottom of the ground plate 101. One of the terminals is then attached on one of the long sides of the slot 103 and the other terminal is attached on the opposite side. The coaxial line 107 can reach the excitation point of the antenna 100 either through a window in the body of the transmission line 105 (as in FIG. 3*c*) or through one of the ends of the transmission line 105 (as in the FIG. 3*d*) when the coaxial line is positioned below the ground plane as shown in the FIG. 3*b*. When the transmission line has ends, a window would similarly be introduced for the arrangement in FIG. 3*d*. When the coaxial line 107 is placed right on the top of the ground plane, as shown in the FIG. 3*a*, such a window is not needed. In both cases, the outer conductor of the coaxial line 107 can be electrically connected to the first slot edge and the inner conductor, after crossing the slot 103, is electrically connected to the opposite side of the slot.

Figure 3E:
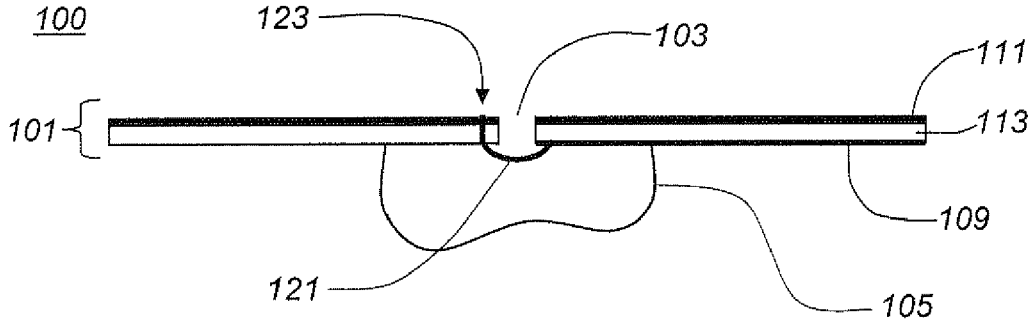
Figure 3F:
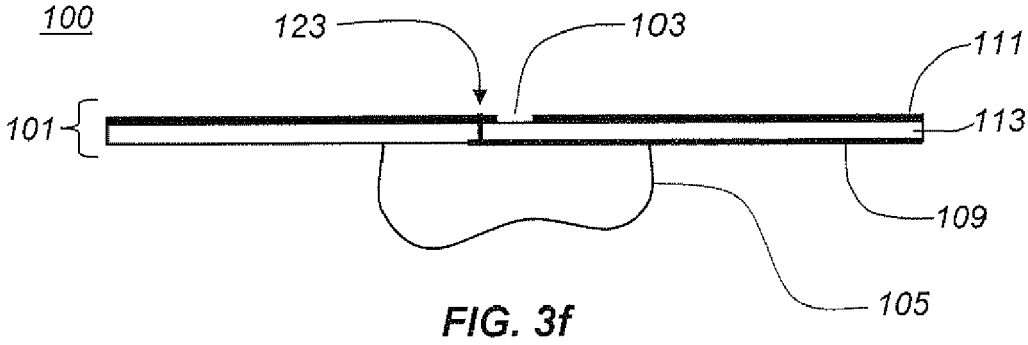
Figure 3G:
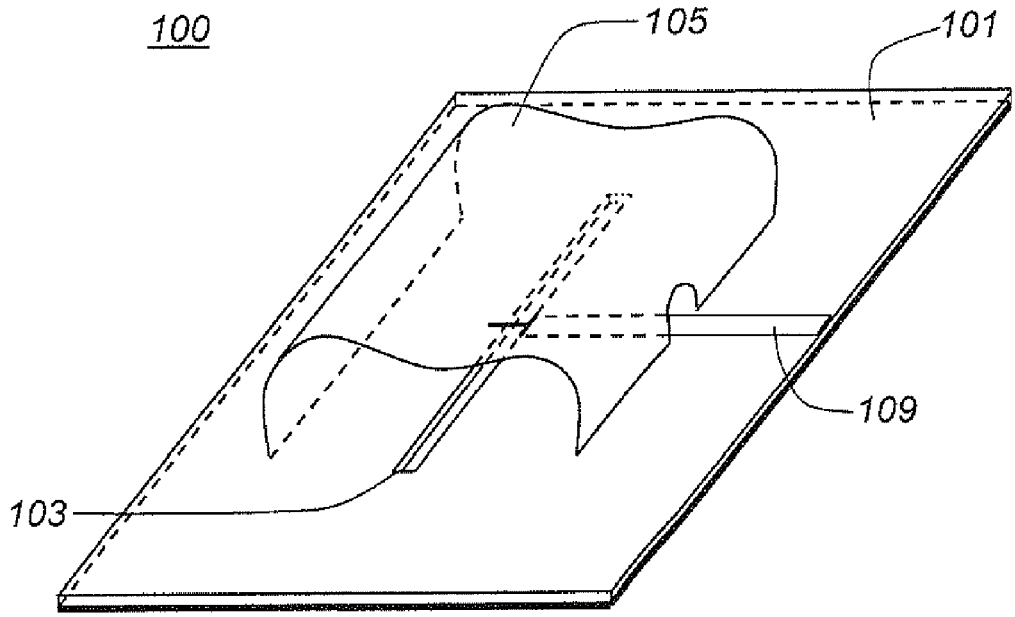
Figure 3H:
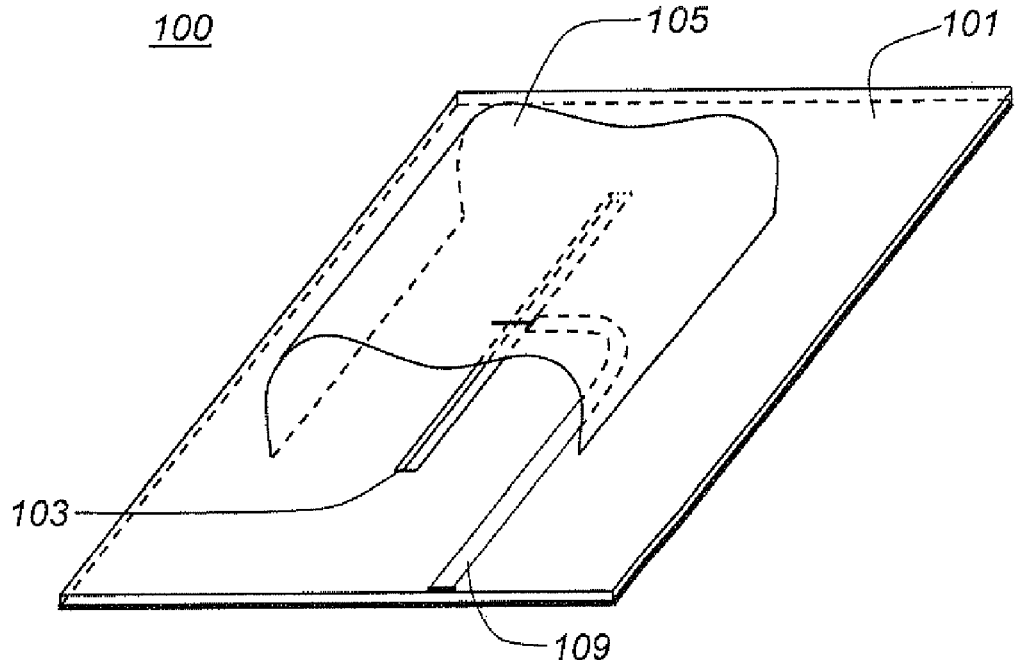
Figure 3I:
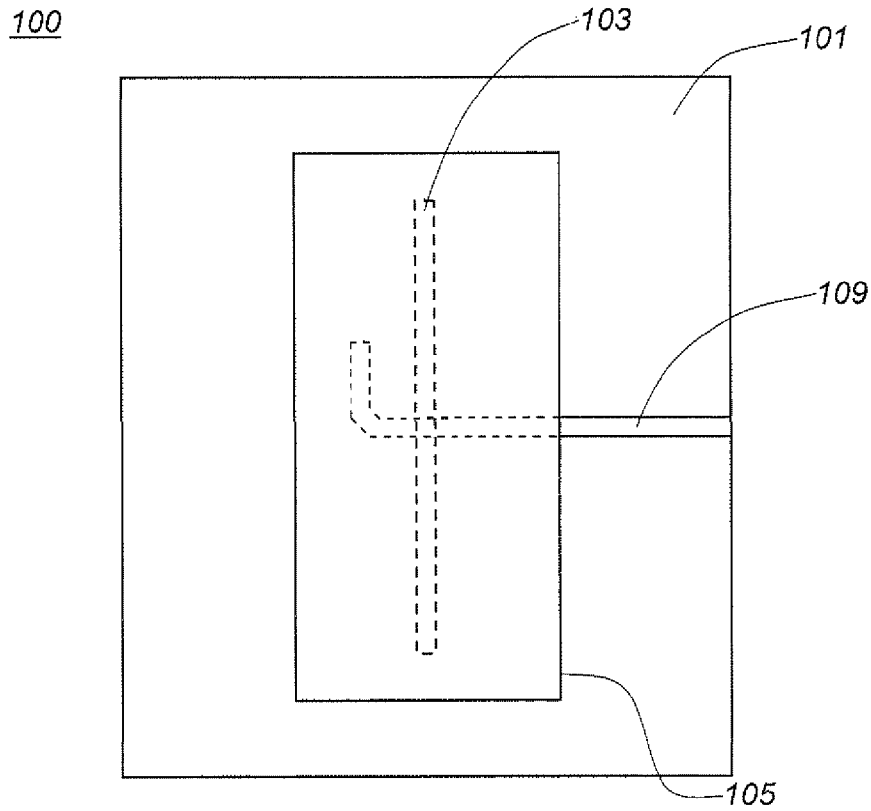

Excitation of the antenna by a micro-strip line can use a dielectric layer on the ground plane of the antenna, as shown in FIGS. 3*e* and 3*f*. In FIGS. 3*e* and 3*f*, the ground plate 101 has a conductive top layer 111 and a dielectric layer 113. The dielectric layer 113 can overlap with the slot 103 cut in the ground plane 101, as in FIG. 3*f*, where the slot is only cut in the conductive layer 111. The slot can also be cut through the ground plane's dielectric layer 113, as shown in FIG. 3*e*. If the slot is free of the dielectric layer 113, as in the FIG. 3*e*, the micro-strip 109 is electrically connected to the opposite side of the slot 103 by a thin conductor 121, which is soldered or otherwise attached to the micro-strip line 109 after crossing the slot 103 and passing through a hole 123 in the dielectric and the ground plate it is soldered to its upper side. If the slot is filled with the dielectric, the micro-strip 109, after crossing the slot 103, can be shorted to the ground plane by a via 123 as in the FIG. 3*f*, or extend for approximately quarter wavelength after crossing the slot and remain open as in the FIG. 3*i*. As with the coaxial case, the micro-strip 109 can pass though a hole in the side of the screen 105, as in FIG. 3*g*, or enter through the end as in FIG. 3*h*.

Looking at the example presented in FIG. 3*f* in more detail, the micro-strip line is on the lower surface of the dielectric layer 113, which is on the lower side of the ground plate 101. The micro-strip line 109 goes under the slot 103 to the opposite side and connected to the via (for example, a hole drilled through the extended micro-strip, dielectric layer and the ground plate and filled with a conductive material) that goes through the dielectric layer, thereby connecting the micro-strip with the ground plane on its conductive upper side. The micro-strip line 109 should not touch the cylindrical screen sections 105. The choice of the type of excitation (shorted, extended open) depends on the desired bandwidth for operation of the antenna. The resonant nature of the quarter wave stub results in a narrower band of operation of the antenna compared with the shorted micro-strip excitation.

In the discussion above, the feed has mainly been connected to the ground plate near the center of the long sides of the slot. Having the excitation point at the mid-point of the slot, or in its vicinity, will result in the antenna's response being most sharply peaked at a single frequency. This configuration with the excitation point at the mod-point of the slot is often preferred for use in a single frequency operation mode. Instead of the symmetrical arrangement of the feed just described, the attachment point can be shifted from the center of the slot. The configuration with an off-center or an asymmetrical feed can be used when a response on multiple different frequencies is desired.

Figure 4A:
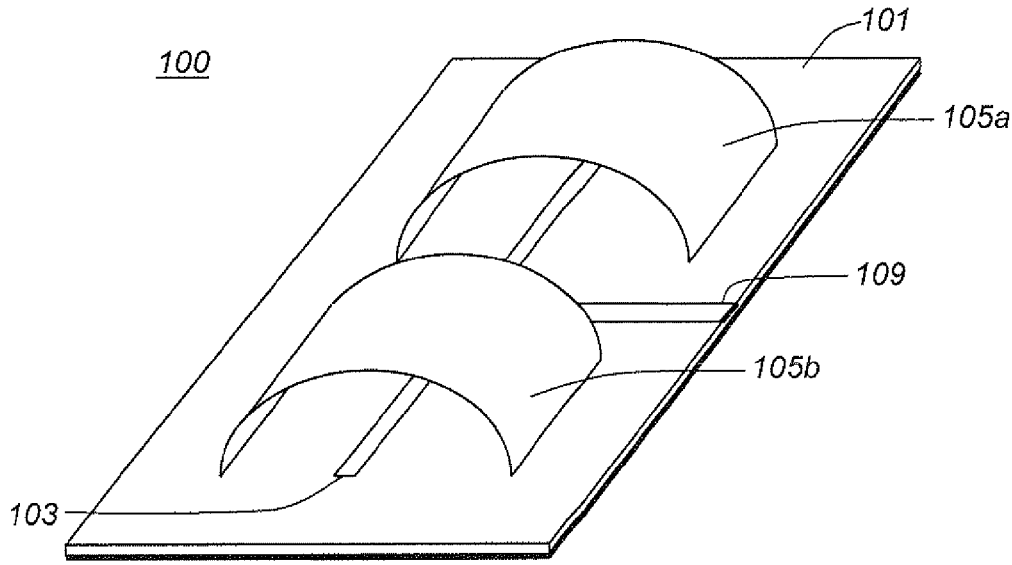
FIGS. 4*a*-4*e* illustrate embodiments where the transmission line is made up of several segments.
Figure 4B:
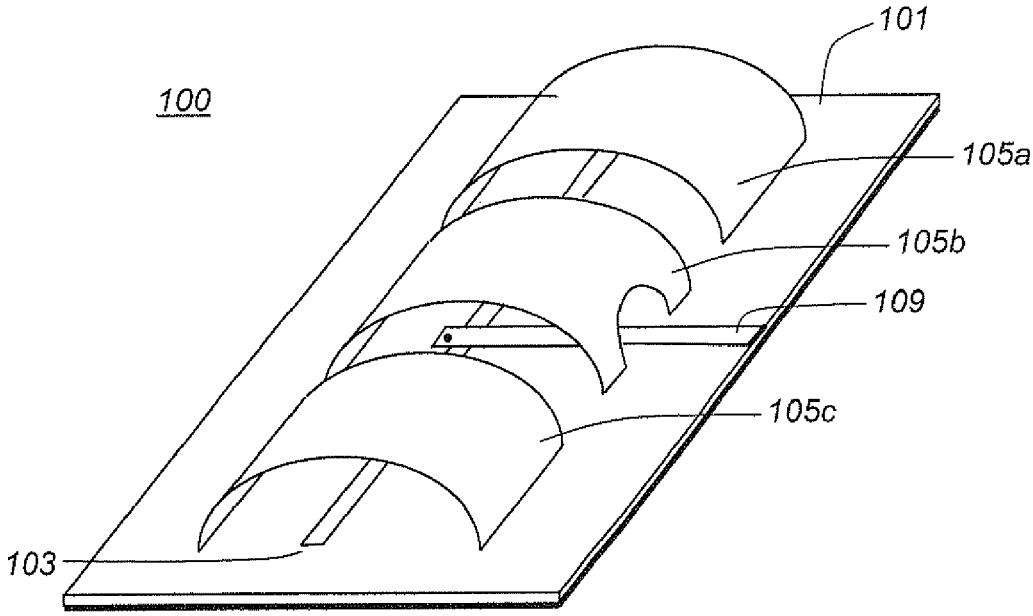
Figure 4C:
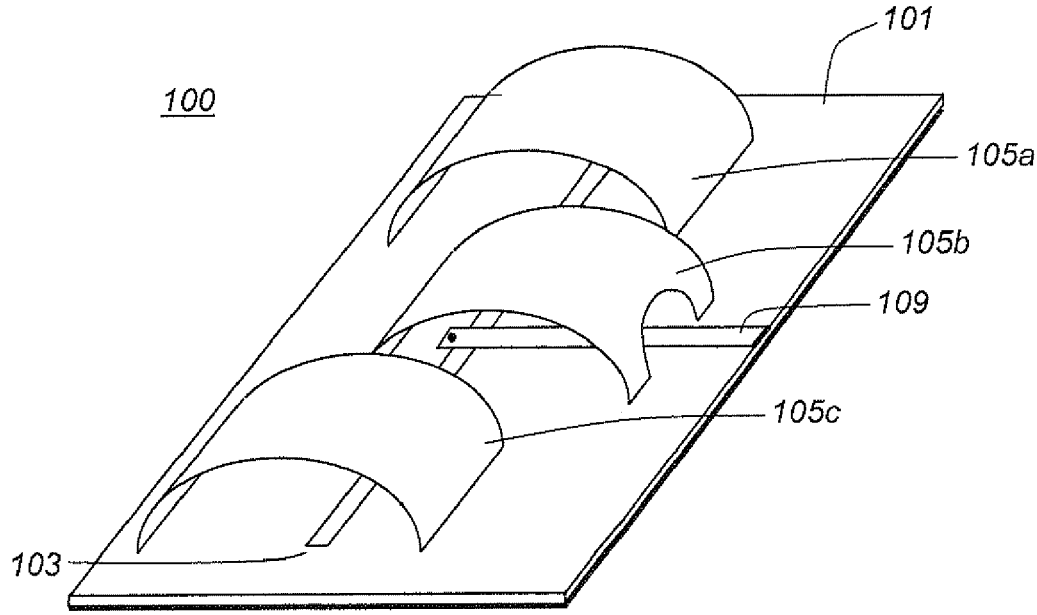
Figure 4D:
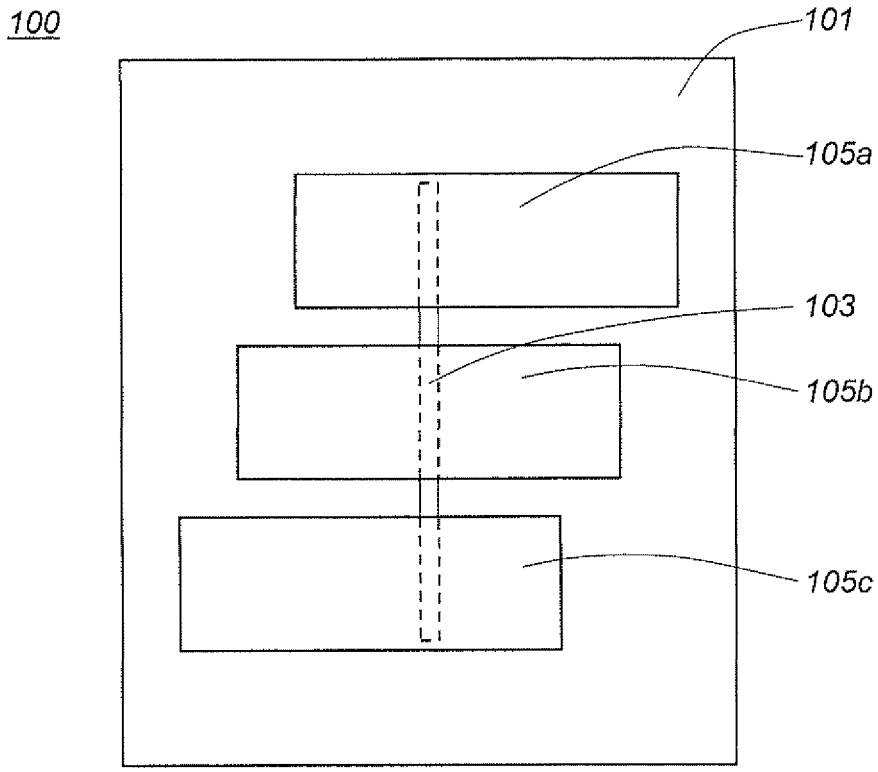
Figure 4E:
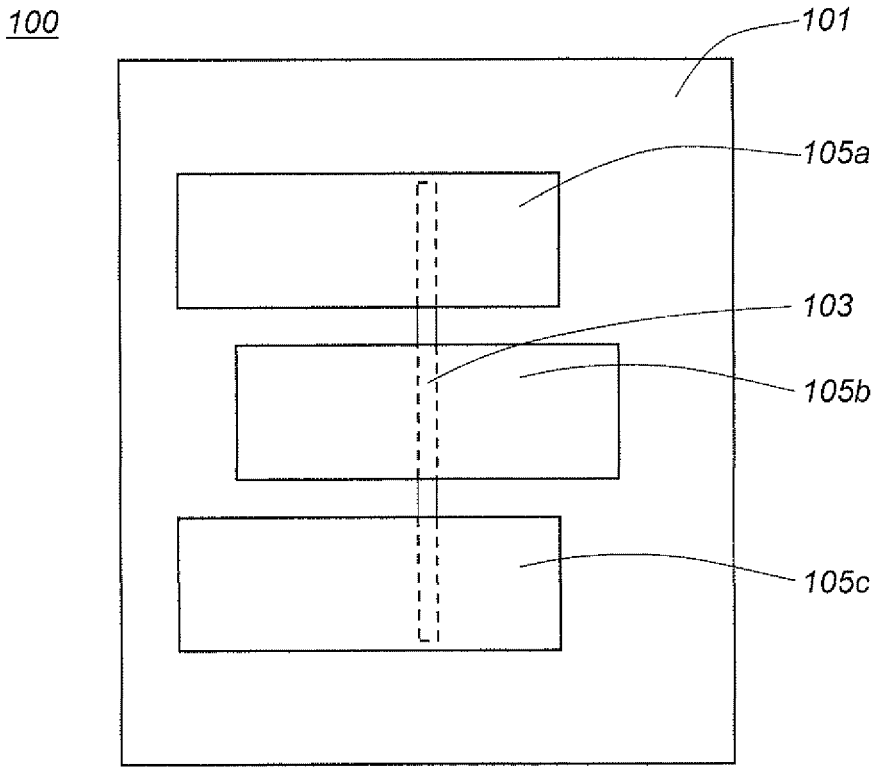

The conductive screen 105 forming the transmission line can be partitioned into several segments. Some parts of the conductive screen can be removed as shown in the FIG. 4*a* (105*a*, 105*b*) and FIG. 4*b* (105*a*, 105*b*, 105*c*). The number of sections of the transmission line can vary from 2 to a large number depending on manufacturing restrictions or space limitations, with the sections preferably of the same, or very similar, shapes tuned to support the same radiation waveguide mode $H_{00}$. Although in many configurations the axis of each section will run along the slot, the position of each section with respect to the slot is not necessarily the same—FIGS. 4*c* (105*a*, 105*b*, and 105*c*). As discussed above, the sections need not necessarily be parallel to the slot. FIG. 4*d* shows the bottom view of the antenna with a three section transmission line whose top section is shifted to the right and whose bottom section is shifted to the left the slot. FIG. 4*e* shows the bottom view of the antenna with two section transmission line whose top and bottom sections are shifted to the left of the slot. The actual position of the transmission line sections and their shapes can be determined based on specific design requirements. The ends can be closed.

Figure 5A:
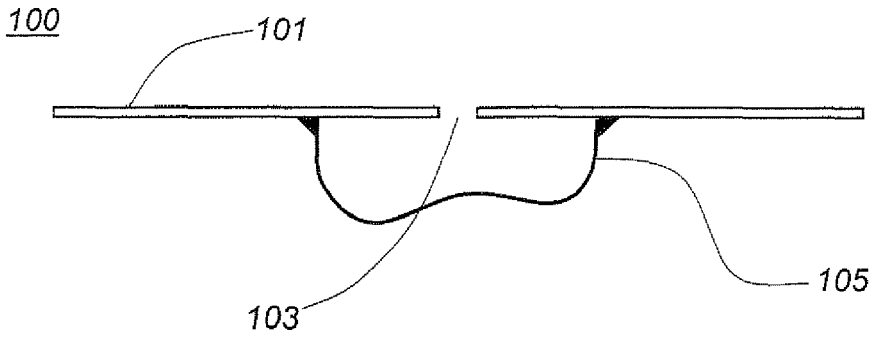
FIGS. 5*a*-5*g* show various embodiments of how the transmission line can be conductively connected to the conductive top surface of the ground plate.
Figure 5B:
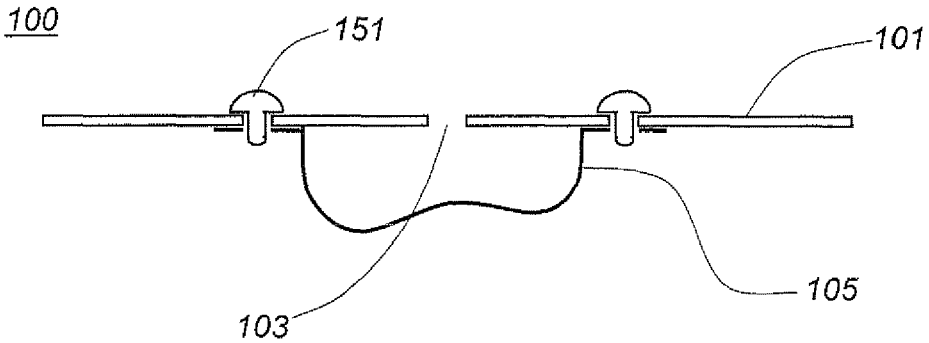
Figure 5C:
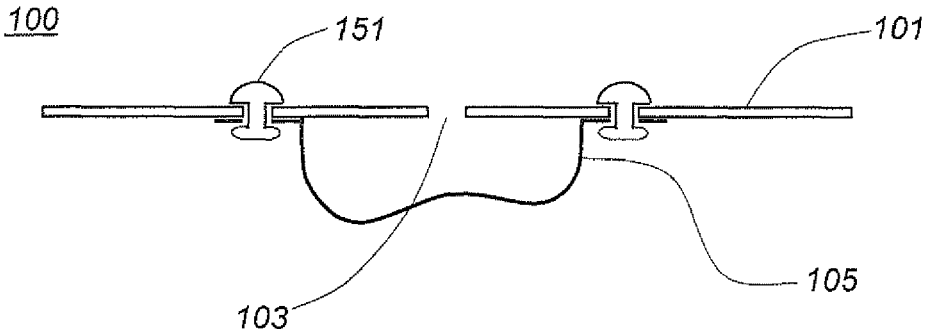
Figure 5D:
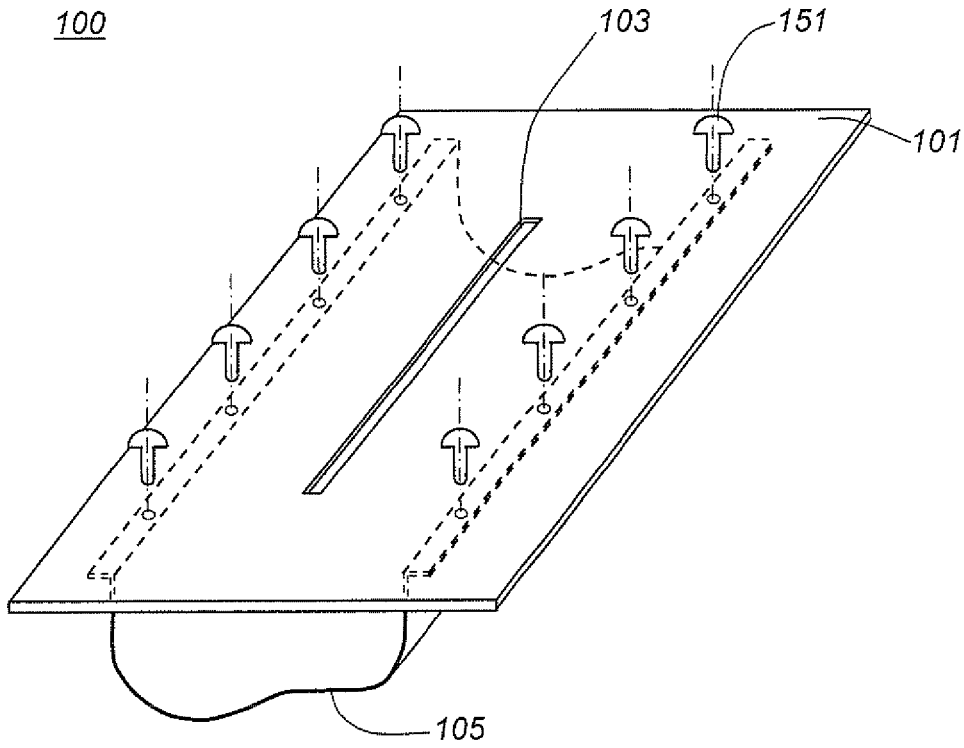
Figure 5E:
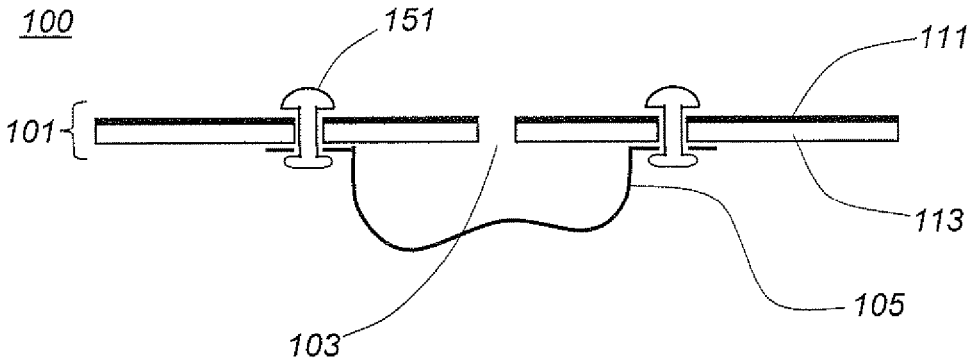
Figure 5F:
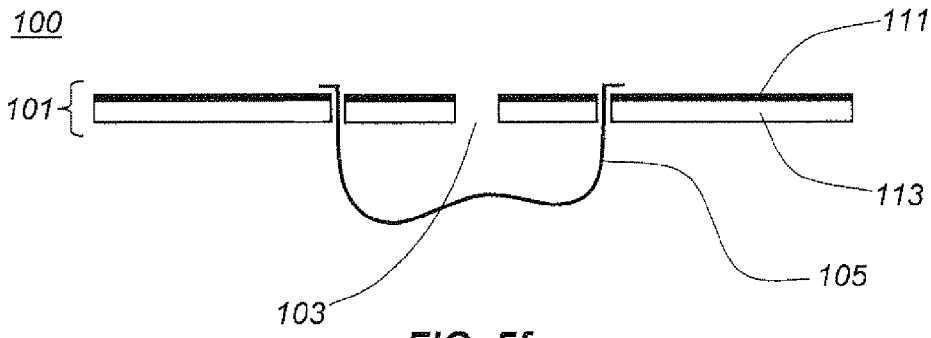
Figure 5G:
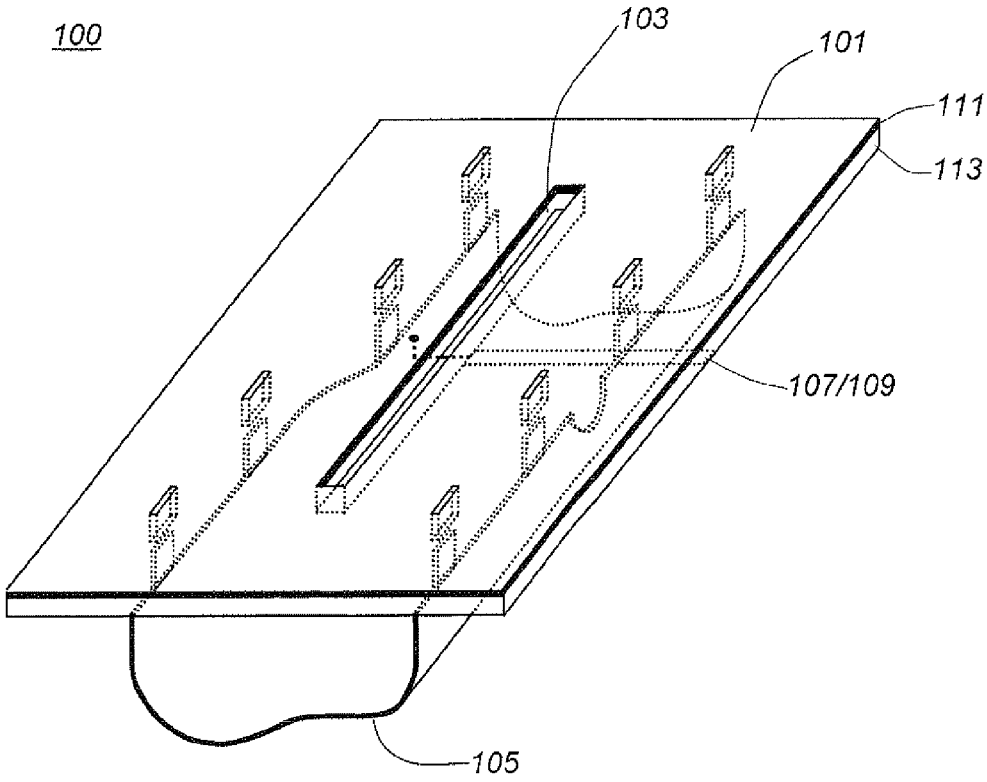

As also discussed above, the transmission line is conductively connected to the conductive top surface of the ground plate. The electrical connection of a transmission line 105 and the ground plate 101, in case of the absence of a dielectric layer, can be done by means of soldering, welding, screwing, bolting or riveting parts as respectively shown in FIG. 5*a*, 5*b*, 5*c*, or 5*d*, with the various conductive connectors shown as 151. When the ground plate is formed on a dielectric layer as in FIGS. 3*e* and 3*f*, the electrical connection of the transmission line body 105 to the conductive top surface 111 of the ground plate can be done through holes drilled in the ground plate layer 111 and dielectric 113, as in FIG. 5*e* or FIG. 5*f*, or through slots in the dielectric and the ground plate, as demonstrated in FIG. 5*g*.

The minimum number of points at which the transmission line body 105 is electrically connected to the ground plate along each side of the slot is equal to 2, for a total 4 contact points. In the case when the transmission line body is composed of several sections, the number of contact points for each section can be 1 or more on each side. With the contact points on each side of the transmission line, the antenna will operate largely the same as a one-section antenna with continuously soldered/welded parts. More generally, the number of contact points can vary and can be greater than 4. Taking into account that the slot length L is preferably greater than the half wavelength in the free space and less than one wavelength, the distance between connection points for the case of 4 points on each side is about 0.2 times the wavelength, which is much larger than what was considered acceptable in the prior art designs.

Figure 6A:
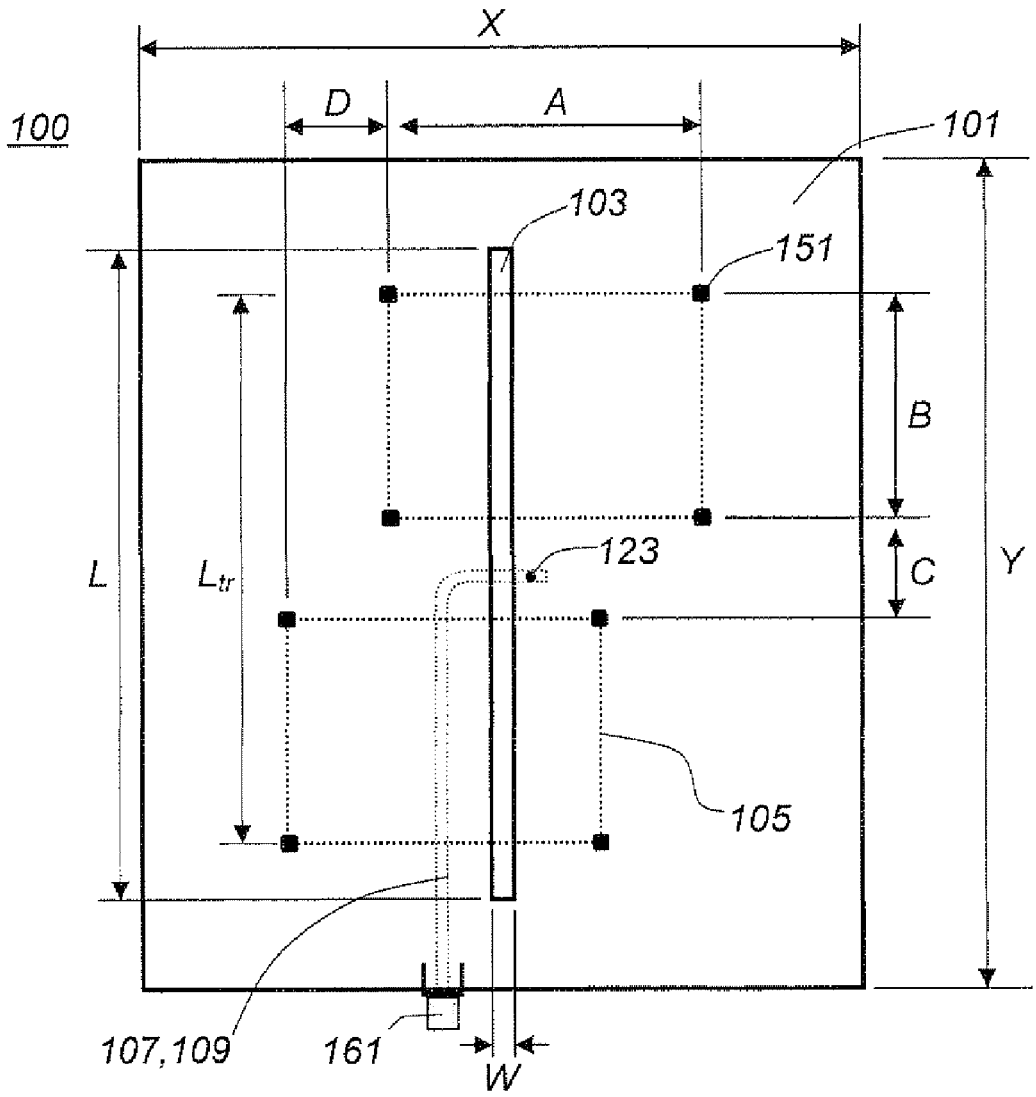
FIG. 6*a* is a particular embodiment and some relevant dimensions.
Figure 6C:
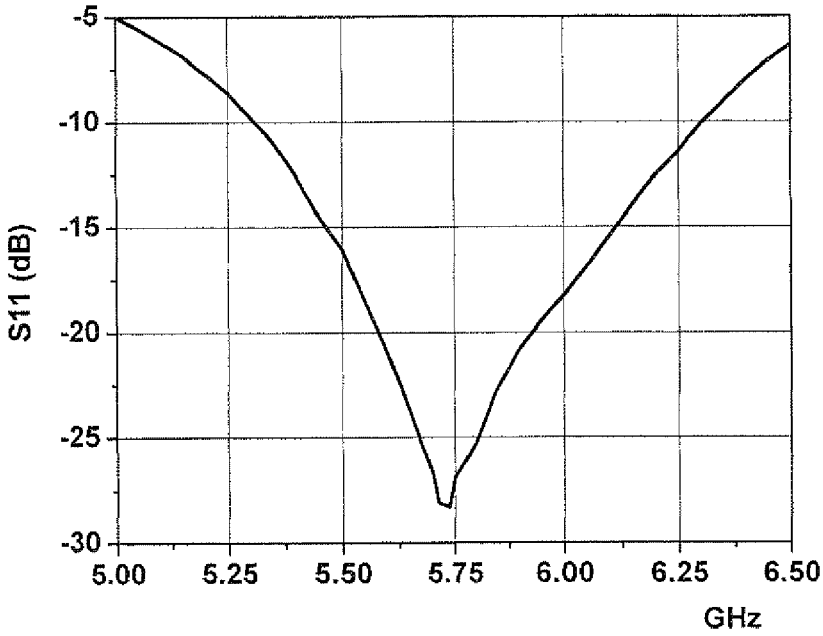
Figure 6C:
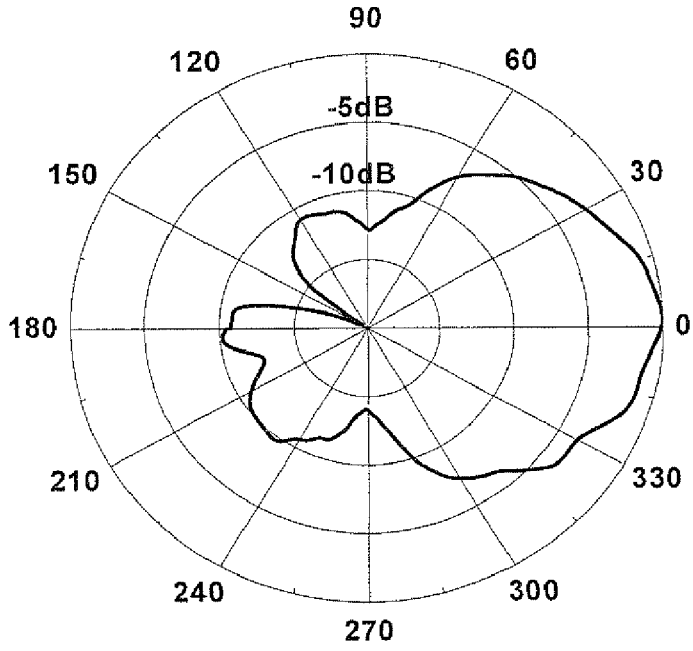
Figure 6D:
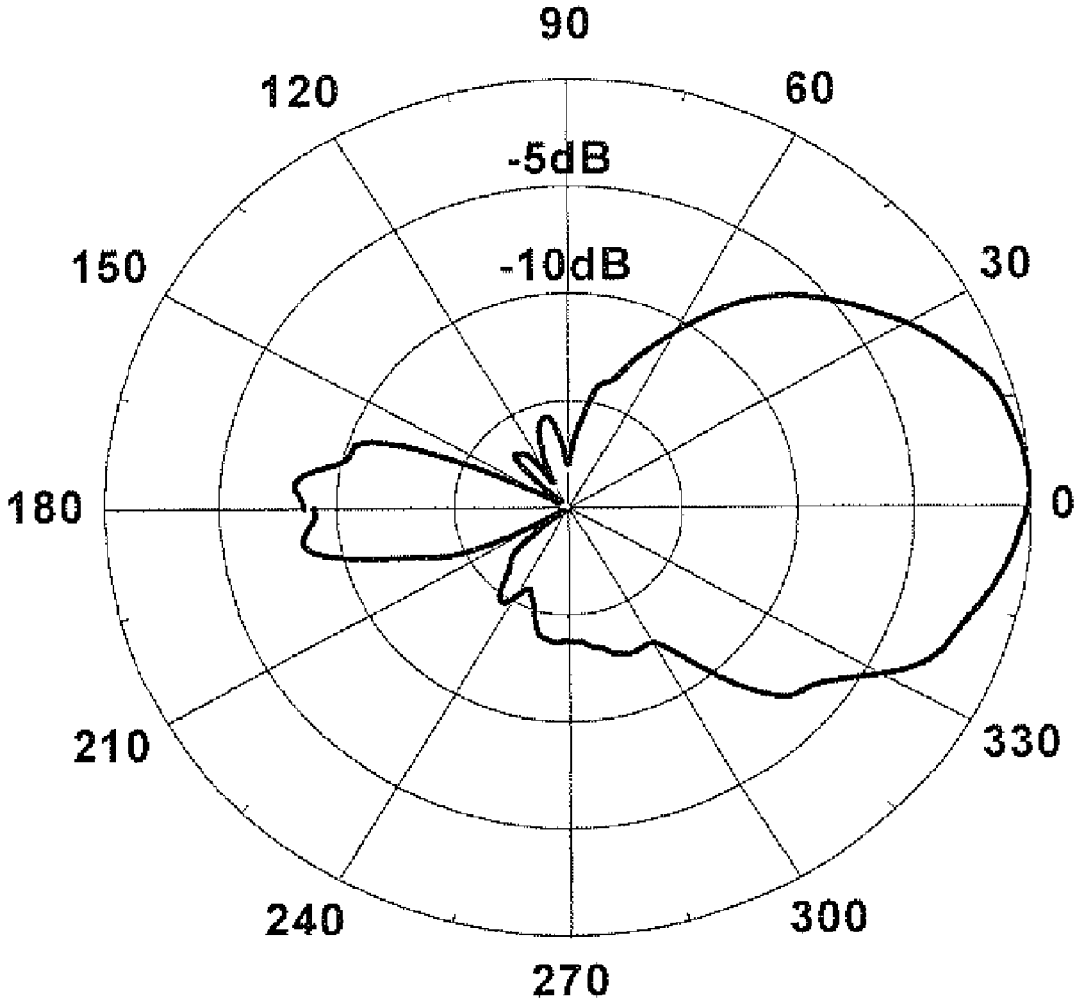

FIGS. 6*b*, 6*c*, and 6*d* show the behavior of a specific example of the antenna as shown in FIG. 6*a*. The arrangement here is a design for a single operating frequency peaked at 5.75 GHz. The measured antenna gain is 8.6 dBi. Other designs could be tuned to other operating frequencies, such as from 2.4000 GHz to 2.4835 GHz for a WiFi antenna application.

FIG. 6*b* shows the measured return loss of the antenna shown in the FIG. 6*a* with ground plate 101 dimensions of X=45 mm and Y=65 mm. The ground plate is formed of RO4350B high frequency laminate with the slot 103 cut through the upper layer of 1 oz of copper and the 30 mill dielectric layer with width W=2.1 mm and length L=41 mm. The transmission line 105 consists of two sections made of 0.1 mm brass shim, shifted with respect to the slot. The sections' dimensions are A=18 mm, B=15 mm and the depth of the transmission line is 11 mm. The distance between the sections is C=8 mm and the shift between the sections is D=5 mm. The upper transmission line section is shifted to the right by 2.5 mm of the center, and the lower section is shifted to the left by 2.5 mm. The transmission line length is $L_{tr}$=38 mm. The transmission line body 105 is connected to the copper layer on the upper surface of the laminate by copper rivets 151, four on each side of the slot, with 8 mm distance between them. The slot 103 is excited by a micro-strip line 109 etched on the bottom side of the laminate. The micro-strip is electrically connected to the ground plate by a copper wire that is soldered on one side to the micro-strip and, after crossing the slot and passing through a hole 123, is soldered to the other side of the ground plate. On its other end, the micro-strip line is connected to a surface mount end-launch SMA connector 161. The transmission line is open on both ends, and the transmission line dimensions are below critical dimensions of the $TE_{10}$ rectangular waveguide mode in the whole of the 5 GHz band. It should be noted that in this configuration the slot length L is greater then the transmission line length $L_{tr}$. The antenna operates on the lowest mode of the slotted cylinder transmission line ($H_{00}$).

FIG. 6*c* and FIG. 6*d* show the measured far field patterns in the E and H planes. The relatively high level of the front-to-back ratio, which is equal to −12 dB, is defined by the ground plate size X~λ. The front-to-back ratio drops down significantly for a larger ground plate size in the E plane (perpendicular to slot). The S11<−10 dB bandwidth of the antenna is ~1 GHz.

Although the invention has been described with reference to particular embodiments, the description is only an example of the invention's application and should not be taken as a limitation. Consequently, various adaptations and combinations of features of the embodiments disclosed are within the scope of the invention as encompassed by the following claims.

It is claimed:

1. An antenna, comprising:

a ground plate with a conductive top surface having a slot of length L and width W formed therein, where W is less than L;

a feed having a ground reference terminal connected to one side of length L of the slot and a signal terminal connected to the other side of length L of the slot; and a conductive cylindrical screen of one or more sections running lengthwise along the slot attached along the bottom surface of the ground plate, each having a first and second edge conductively connected to the top surface of the ground plate along opposing respective sides of length L of the slot, and tuned to support the fundamental mode ($H_{00}$) of a slotted open cylindrical transmission line formed by the screen sections, the ground plate and the slot.

2. The antenna of claim 1, wherein the feed terminals are connected at the center of the respective sides of the slot.

3. The antenna of claim 1, wherein the feed terminals are connected at a point shifted from the center of the respective sides of the slot.

4. The antenna of claim 1, wherein the feed is a coaxial cable.

5. The antenna of claim 1, wherein the feed is a micro-strip transmission line.

6. The antenna of claim 1, wherein the cylindrical conductive screen has one section.

7. The antenna of claim 1, wherein the cylindrical conductive screen has multiple sections.

8. The antenna of claim 1, wherein the ends of the sections of the cylindrical conductive screen are open.

9. The antenna of claim 1, wherein the ends of the sections of the cylindrical conductive screens are closed.

10. The antenna of claim 9, wherein the ends of the sections of the cylindrical conductive screen are non-conductive.

11. The antenna of claim 9, wherein the ends of the sections of the cylindrical conductive screen are conductive.

12. The antenna of claim 1, wherein the cylindrical conductive screen has a non-rectangular cross-section.

13. The antenna of claim 1, wherein the conductive top surface of the ground plate is formed on a dielectric layer through which the conductive screens are conductively connected to the top plate.

14. The antenna of claim 1, wherein the antenna is tuned to have an operating frequency region of around 2.4 GHz.

* * * * *